US009944507B2

(12) United States Patent
Jury

(10) Patent No.: US 9,944,507 B2
(45) Date of Patent: Apr. 17, 2018

(54) BOTTLE OPENER

(71) Applicant: Adine Pty Ltd, Geelong (AU)

(72) Inventor: Gregory Arthur Jury, Jan Juc (AU)

(73) Assignee: ADINE PTY LTD, Geelong (AU)

( * ) Notice: Subject to any disclaimer, the term of this patent is extended or adjusted under 35 U.S.C. 154(b) by 294 days.

(21) Appl. No.: 14/900,714

(22) PCT Filed: Jun. 26, 2014

(86) PCT No.: PCT/AU2014/050096
§ 371 (c)(1),
(2) Date: Dec. 22, 2015

(87) PCT Pub. No.: WO2014/205520
PCT Pub. Date: Dec. 31, 2014

(65) Prior Publication Data

US 2016/0145087 A1 May 26, 2016

(30) Foreign Application Priority Data

Jun. 27, 2013 (AU) ..... 2013902381
Jul. 30, 2013 (AU) ..... 2013902830

(51) Int. Cl.
*B67B 7/16* (2006.01)

(52) U.S. Cl.
CPC ..... *B67B 7/16* (2013.01)

(58) Field of Classification Search
CPC ..... B67B 7/16; B67B 7/164; B67B 7/162
See application file for complete search history.

(56) References Cited

U.S. PATENT DOCUMENTS

| | | | |
|---|---|---|---|
| 4,414,866 | A | 11/1983 | Kichijyo |
| 6,041,532 | A | 3/2000 | Pollhaus et al. |
| 7,152,506 | B2 | 12/2006 | Wang |
| D644,078 | S | 8/2011 | Moman |
| 2009/0133537 | A1 | 5/2009 | Uglum |

*Primary Examiner* — David B Thomas
(74) *Attorney, Agent, or Firm* — Marsh Fischmann & Breyfogle LLP; Jonathon A. Szumny

(57) ABSTRACT

The invention is directed to a push opener for bottles. The push opener includes a mechanism configured to remove a bottle cap when the opener is introduced over a bottle and pushed downwardly, and trigger a promotional or entertainment action.

16 Claims, 8 Drawing Sheets

BOTTLE OPENER

FIELD OF THE INVENTION

The invention relates to a bottle opener, and more specifically a 'push down' bottle opener—referred to herein as a push opener—that can be operated by one hand.

BACKGROUND TO THE INVENTION

Many types of different devices are known for removing the cap from a bottle, such as a crown cap from a bottle of beer or soft drink. Generally, cap remover with a hole or engaging means at one end is applied under one side of the rim of the cap in a levering motion by a user, to pry up the cap. Generally, this action requires the use of both hands, as the levering force would otherwise tend to upset the bottle and risk spilling its contents. Further, the cap often flies off, which can be an inconvenience.

Other types of bottle opener have been developed, including 'push down' openers (referred to herein as a push opener), which can be operated with one hand. With such openers, an upper end of the bottle, which includes the cap, is inserted into a lower opening of the push opener, and then by pushing downward on the push opener the cap is removed by way of the prying lever action of an internal mechanism. However, such devices have not generally received widespread acceptance.

It is an object of the invention to provide a new article of barware or kitchenware, and particularly a new bottle opener.

Any discussion of documents, acts, materials, devices, articles and the like in this specification is included solely for the purpose of providing a context for the present invention, it is not suggested or represented that any of these matters formed part of the prior art base or were common general knowledge in the field relevant to the present invention as it existed in Australia or elsewhere before the priority date of each claim of this application.

SUMMARY OF THE INVENTION

In broad form, the invention provides a push opener for bottles, including a mechanism configured to:

(a) remove a bottle cap when the opener is introduced over a bottle and pushed downwardly, and (b) trigger a promotional or entertainment action.

The promotional or entertainment action may be, for example, the playing of a sound recording or the actuation of a visual display.

In another broad form, the invention provides a push opener for bottles, having a bottle cap receiving part, including a bottle-opening mechanism by which, when the opener is placed over a bottle such that the cap on the bottle is received within the cap receiving part, and a downward force is applied to the opener, a hooking member engages the rim underside of the cap and lifts it from the bottle, wherein the bottle-opening mechanism is configured to trigger a promotional or entertainment action when the bottle opener is used.

More specifically, the invention provides a push opener for bottles, having a bottle cap receiving part, including a bottle-opening mechanism by which, when the opener is placed over a bottle such that the cap on the bottle is received within the cap receiving part, and a downward force is applied to the opener, a hooking member engages the rim underside of the cap and lifts it from the bottle, wherein the bottle-opening mechanism is configured to operate a sound unit within the opener to play a sound recording when the bottle opener is used.

The cap receiving part is configured to receive the mouth of the bottle with a cap thereon.

Preferably, the opener has an upper pusher portion to which downward force is applied in operating the opener, shaped and sized for easy engagement by the hand of a user.

The pusher portion may have the shape of a sports ball. The ball may be selected from the group of soccer ball rugby ball, tennis ball, basketball, golf ball, baseball, volleyball, Australian Rules football, gridiron ball, and cricket ball.

The sound recording may be selected in accordance with the ball represented by said pusher portion.

The sound recording may be one of a plurality of sound recordings stored in the sound unit. The particular sound recording played may be randomly (or pseudo-randomly) selected from the plurality.

The sound unit is preferably triggered to play said sound recording by movement of a trigger element moved by motion of a part of said bottle-opening mechanism. The trigger element is preferably moved by engagement with a part of said cap receiving part.

The sound unit may be mounted in a part of the opener separated from said bottle-opening mechanism. The separation may be provided by a partition, said trigger element traversing an aperture in said partition. The partition prevents liquid from the part of the bottle opener containing the bottle-opening mechanism from passing to the sound unit.

The bottle opener may have a main body provided with a lower part to engage or move towards the shoulders of a bottle over which the opener is placed, and said bottle-opening mechanism is a lever mechanism, whereby downward force on the main body causes said cap receiving part to rise relative to said main body, resulting in said hooking member lifting the rim of the cap relative to the bottle. Said main body may be an outer body enclosing said cap receiving part. Preferably, said pusher portion is mounted on said main body.

Typically, the cap receiving part rises relative to the main body from a first rest position to a second, triggering position (typically, to operate the sound unit). In a preferred embodiment, the push opener is configured such that when the opener is placed over a bottle and the downward force is applied to move the main body relative to the cap receiving part, said triggering position is reached before a lower end of the main body engages the shoulders of the bottle. This will typically be achieved by the distance from the point in the cap receiving part where the bottle cap is received and said lower end of the main body when in said triggering position being less than or substantially equal to the length of a neck portion of the bottle (the neck portion length being the distance from the mouth of the bottle to the shoulders).

More particularly, the bottle-opening mechanism preferably includes a lever pivotally mounted to said cap receiving part about a first pivot axis, said lever pivotally connected to said hooking member about a second pivot axis, said first and second pivot axis spaced apart. The bottle opener may be configured such that movement of said main body relative to said cap receiving part causes pivoting of said lever about said first pivot axis to lift said hooking member upward.

Preferably, said main body includes a part which engages an end of said lever when said outer body moves relative to said cap receiving part.

The bottle opener preferably includes a spring to return the mechanism to its original configuration upon removal from a bottle.

The bottle opener preferably includes a means to urge said hooking member inwardly towards the bottle cap as the bottle-opening mechanism is operated. This may be a spring means, or may be a mechanical action resulting from the configuration of the components of the bottle-opening mechanism.

BRIEF DESCRIPTION OF THE DRAWINGS

Embodiments of the present invention will now be described, by way of example only, with reference to the accompanying drawings, in which.

DETAILED DESCRIPTION OF THE DRAWINGS

The structural features and operation of the bottle opener of the invention are illustrated in the figures. The drawings and description are not to be seen as in any way limiting the invention.

To assist with understanding, a list of parts is provided below.

Figure 4:
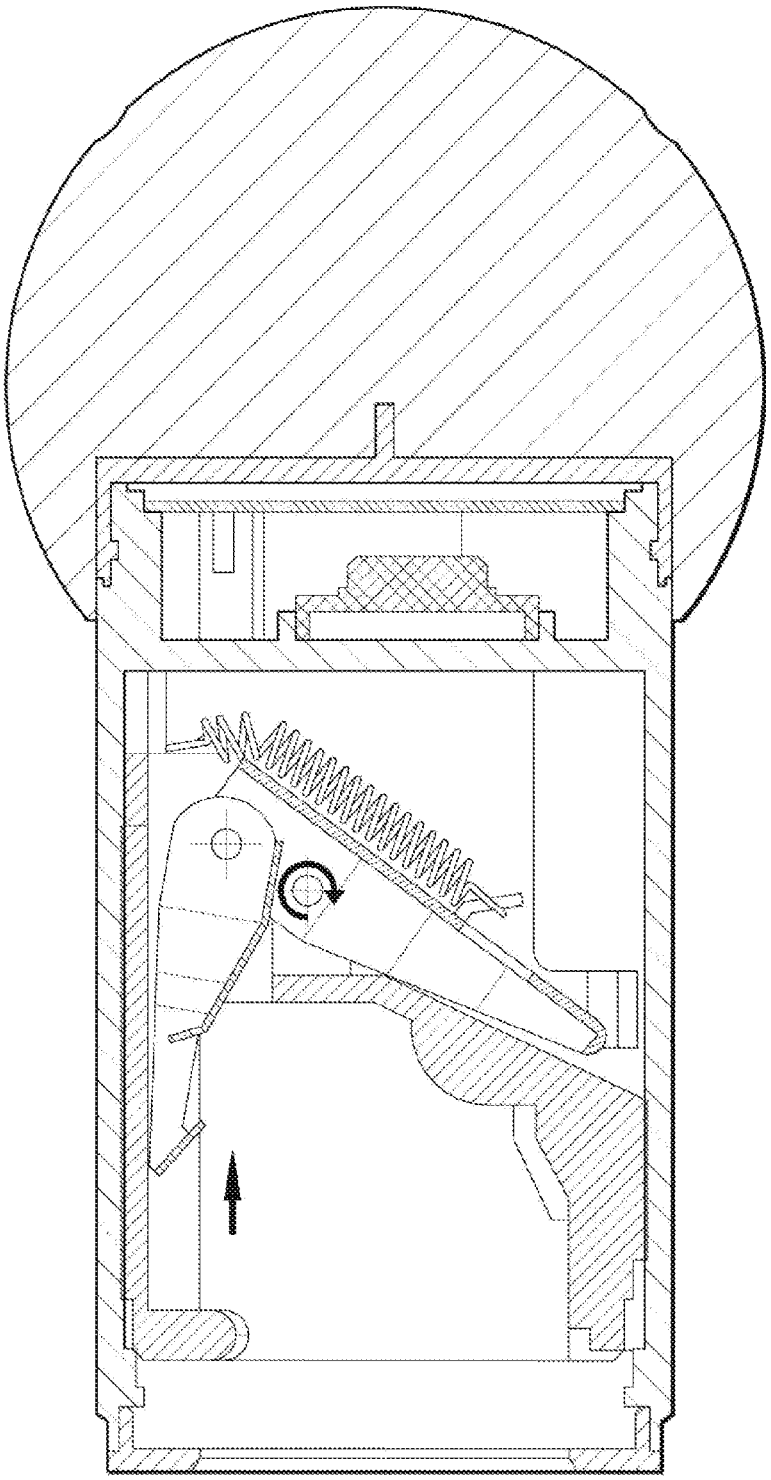
FIG. 4 shows a cross-sectional view of the device of FIG. 2 showing the internal mechanism in a second configuration.
Figure 5:
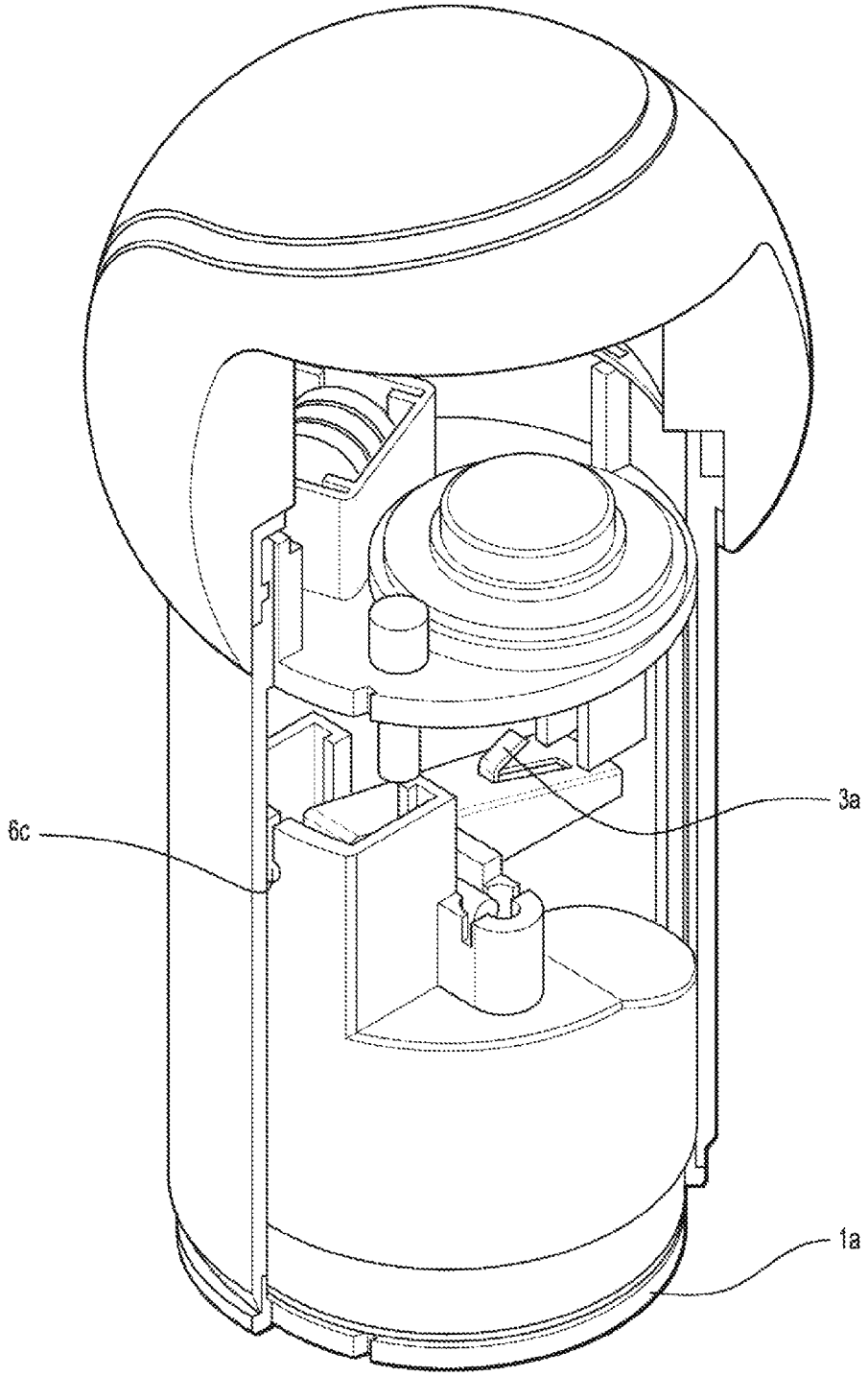
FIG. 5 shows the device of FIG. 2 in cutaway view, with internal mechanism in the first configuration.
Figure 6:
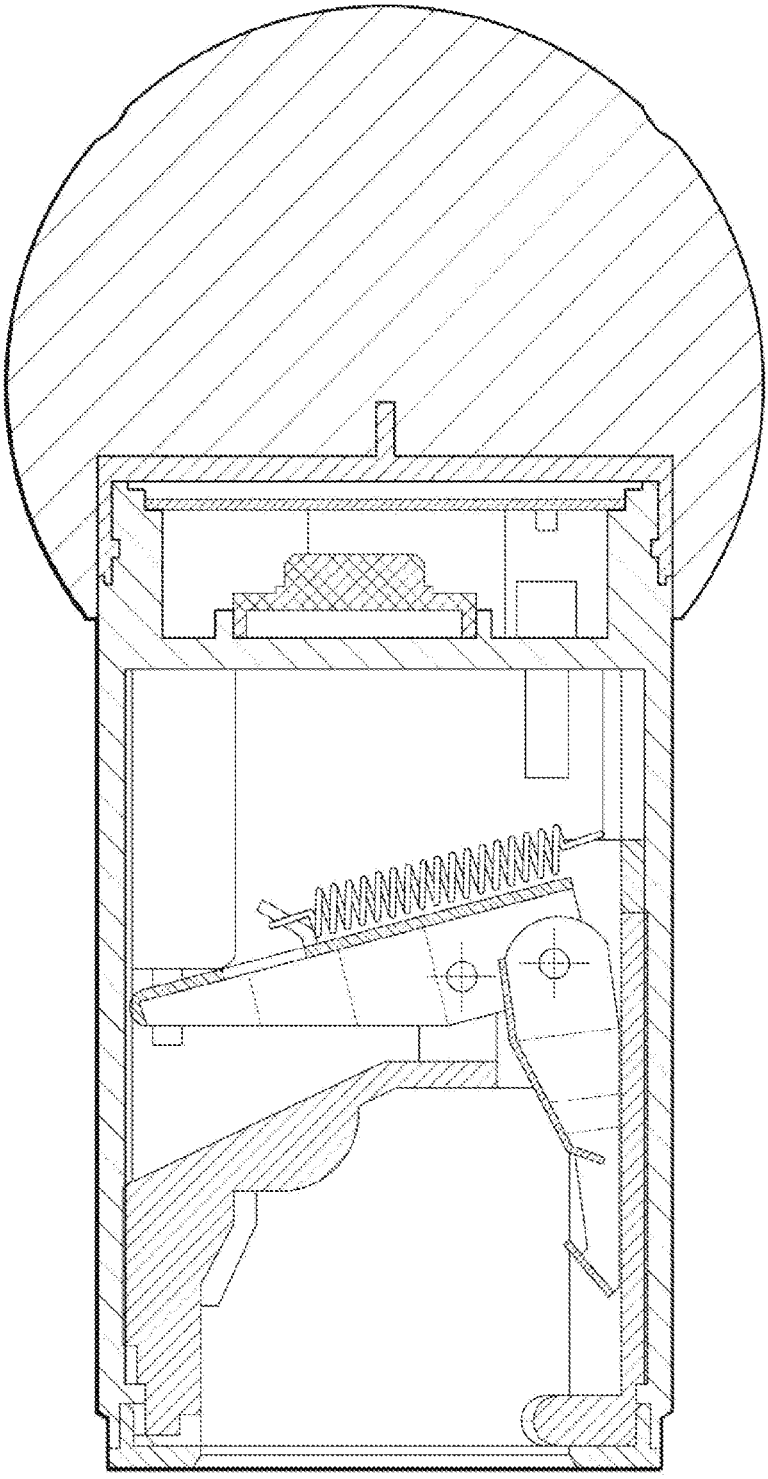
FIG. 6 is similar to FIG. 3, but shows a cross-sectional view in the opposite direction.
Figure 7:
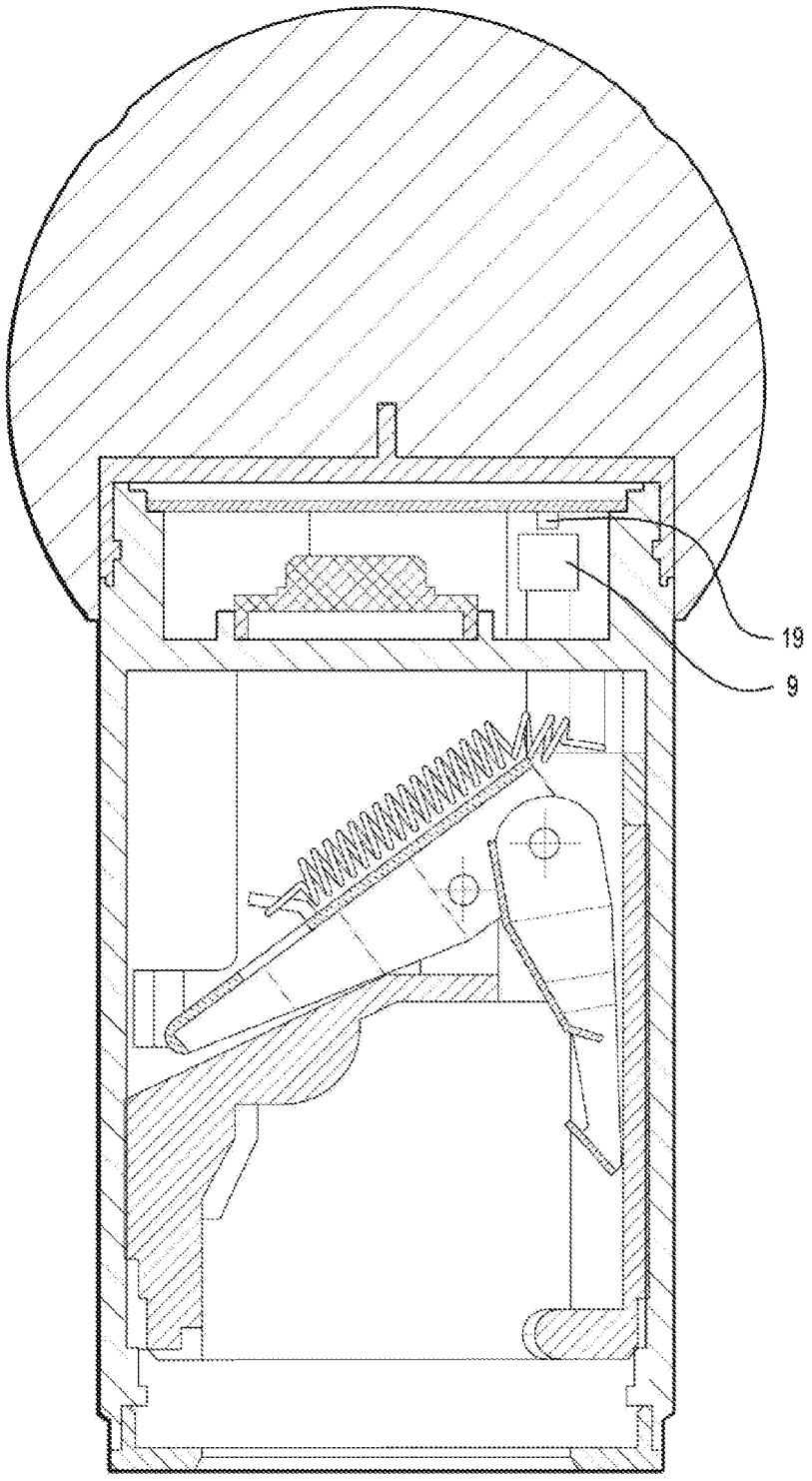
FIG. 7 is similar to FIG. 4, but shows a cross-sectional view in the opposite direction.

The views illustrating the internal mechanism of the bottle opener show it in two positions, a first 'at rest' configuration (see FIGS. 3, 5, 6) and a second 'bottle opening' configuration (see FIGS. 2, 4, 7) when activated. Spring 3*b* acts to return the mechanism from its first to its second configuration.

The top port of the bottle opener provides a pusher 2 formed in the shape of a sports ball for easy handling and advertising purposes, which mounts onto opener body 1, preferably removably so that different pushers 2 can be selectively attached and removed.

Figure 1:
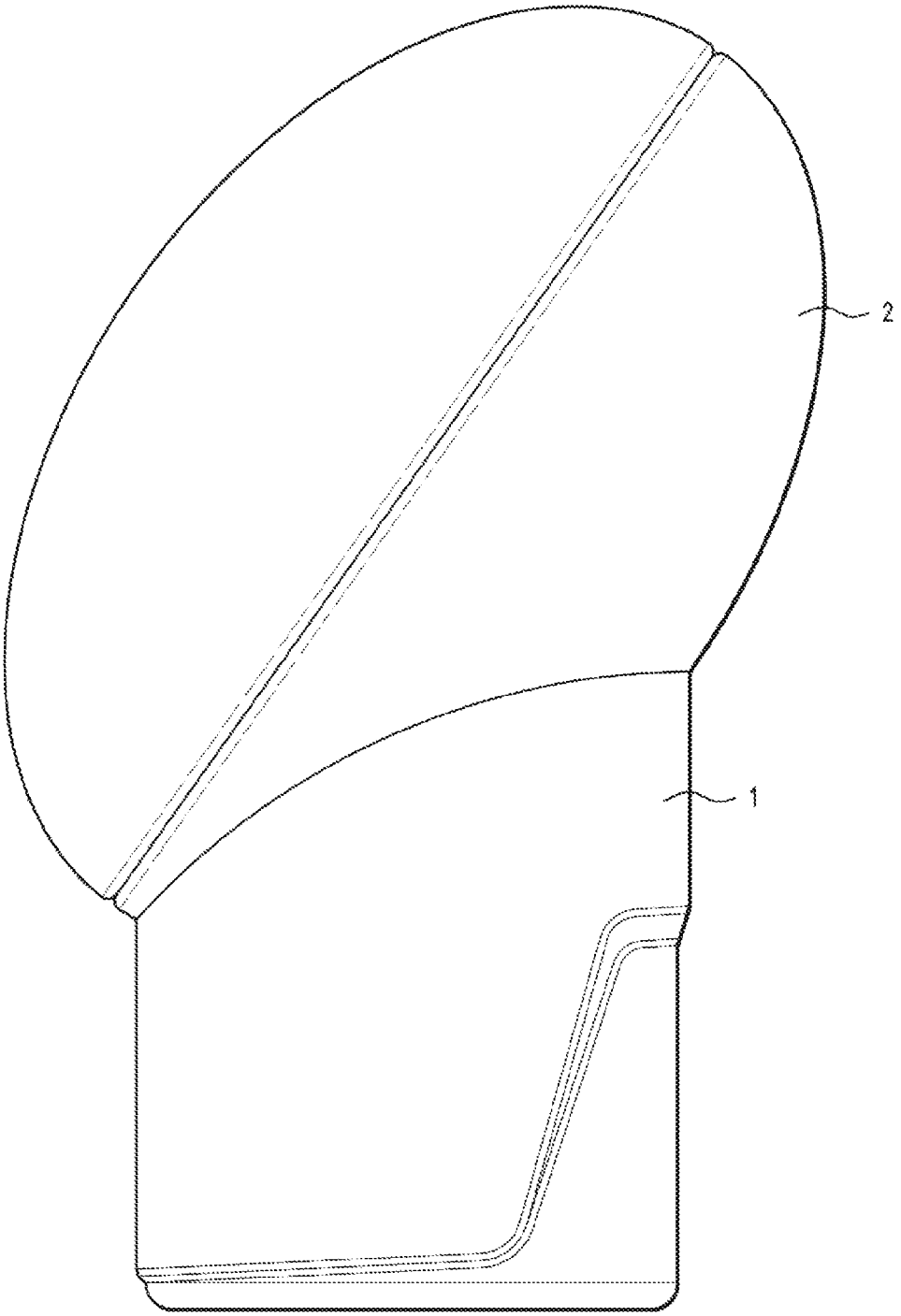
FIG. 1 provides an external view of a device according to the invention, being a push opener with an Australian Rules Football (AFL) ball pusher.
Figure 3:
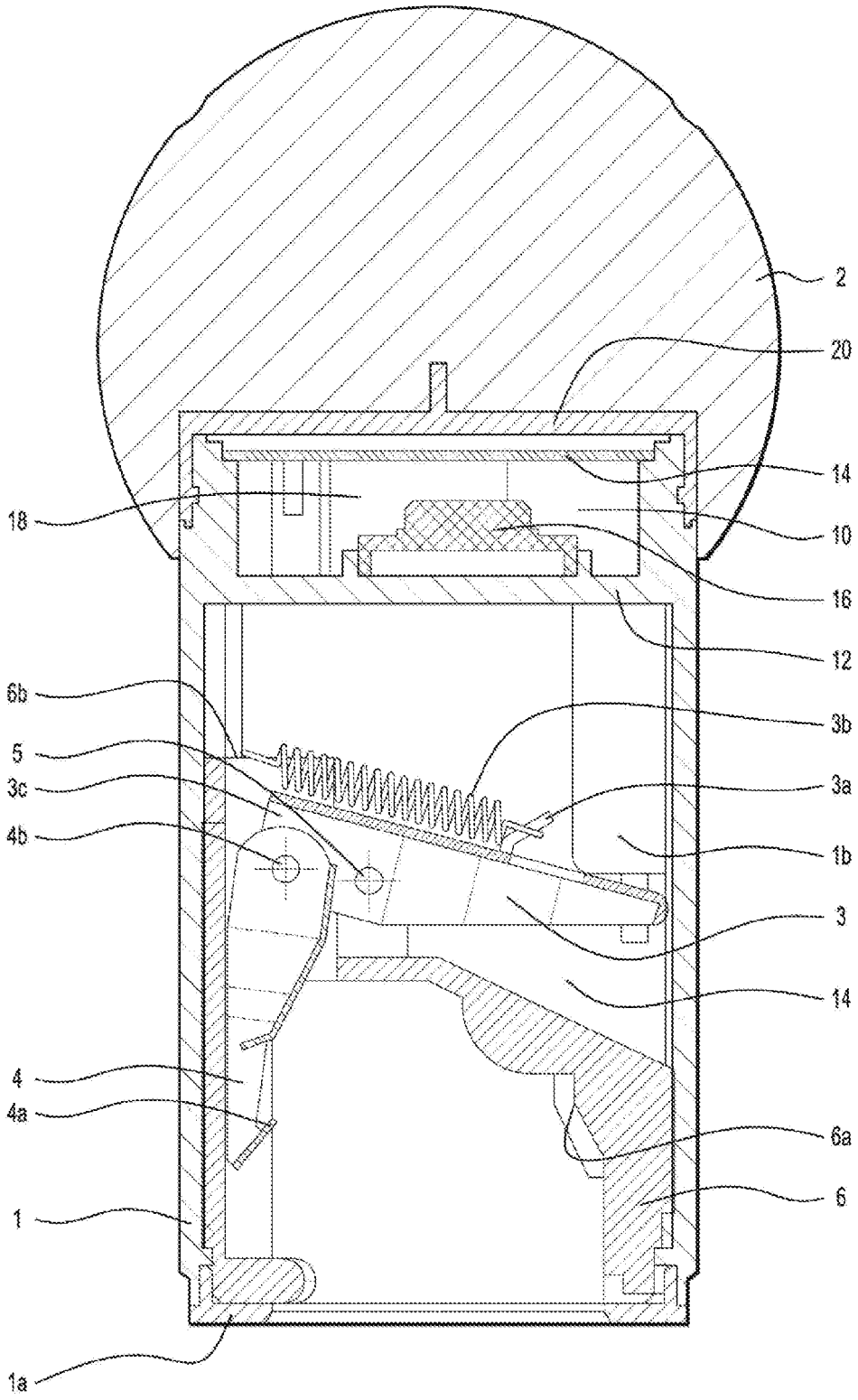
FIG. 3 shows a cross-sectional view of the device of FIG. 2 showing the internal mechanism in a first configuration.
Figure 8:
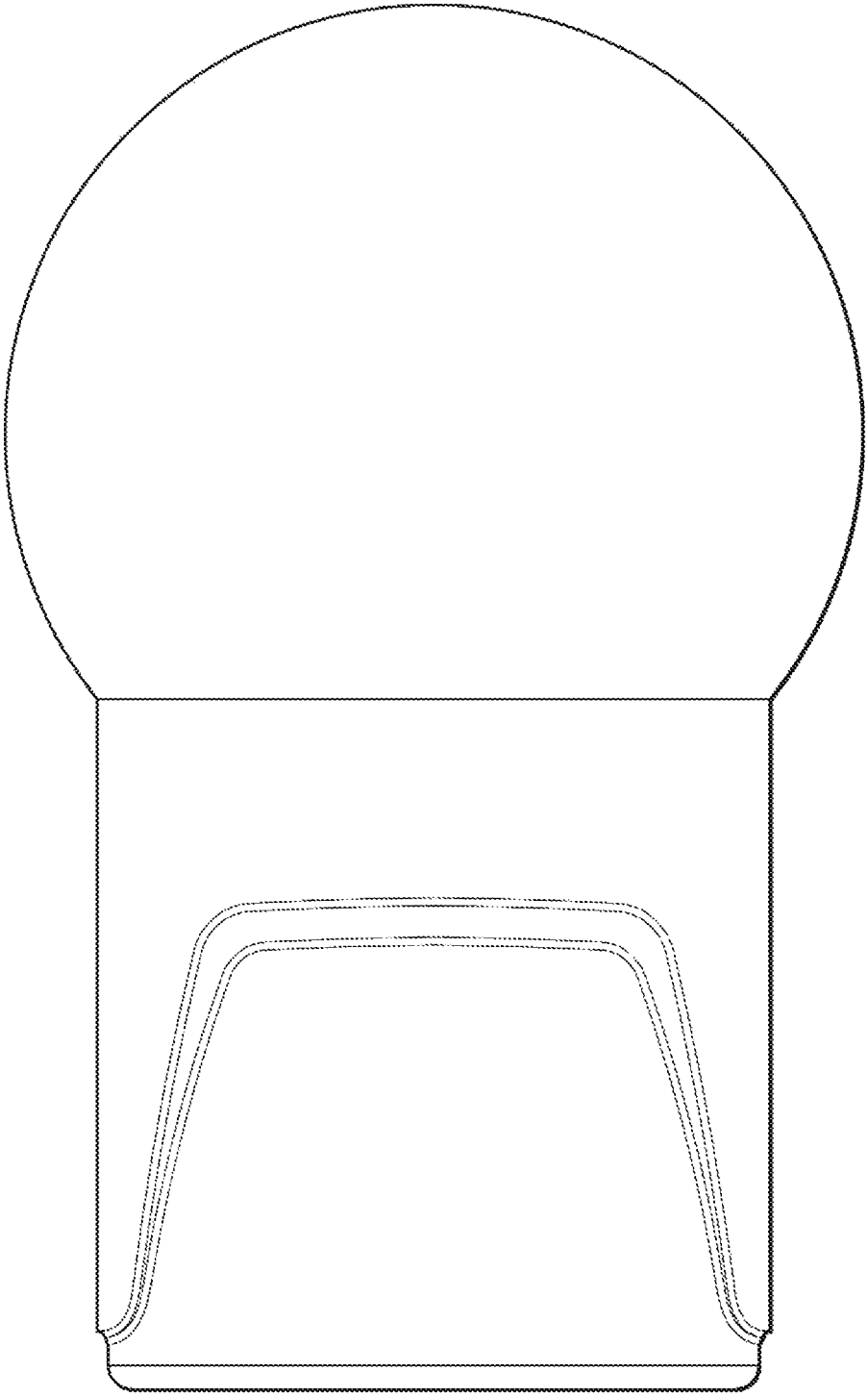
FIG. 8 shows a further external view of a device according to the invention, showing 'trophy' advertising on the body of the device.

Pusher 1 has a generally truncated lower part with an internal cylindrical recess to fit over body 1. Body 1 is cylindrical, having a lower part housing the bottle-removing mechanism and upper part 10 housing a sound unit, which includes a microchip mounted on PCB 14, connected by wires to speaker 16 and battery unit 18. The battery unit 18 may include a cover to protect the battery unit 18 and for safety reasons, for example, in relation to access safety for children. PCB 14 also includes an activation switch 19 (see FIGS. 6, 7), and provides or is mounted on a plate part which at least partially closes upper part 10 of body 1, as shown in FIG. 3. Body 1 is provided with external ornamentation or decoration, such as promotional or advertising material, which may be printed or embossed on a dedicated indented area on the body (see FIGS. 1, 8). This can for example include custom labeling of the opener, eg. for use as a trophy award to a competition winner.

A number of different example forms of ball shapes for pusher 2 are shown in the figures. Pusher 2 may be formed in any other shape, for example a pile of casino chips, a V8 Supercar engine, a 'Magic 8 Ball', a riding jockey's cap, a bicycle saddle, a speedboat, etc.

Body 1 is closed with a cap part 20, to which pusher ball 2 is attached. This enables access as required to the interior of upper part 10, eg. to allow battery changing.

The upper and lower housing parts provided by body 1 are separated by a horizontal partition 12 integrally formed in body 1 as shown. This provides an effective seal between the lower part (which is likely—at least occasionally—to become wet in use) and the upper part housing the electronic components. A bore in partition 12 is sized to accommodate a trigger pin 9, as described below.

The bottle-removing mechanism includes a lever arm 3 mounted for pivotal movement around horizontal pivot 5 mounted as shown in a pivot provided on a receiving socket 6. Socket 6 has a part-cylindrical shaping and is configured to move longitudinally within cylindrical body 1 and to receive the capped top of a bottle. Socket 6 is retained within body 1 by a lower annular part 1*a* Lever arm 3 is configured to provide the required leverage and strength for the load applied in uncapping a bottle cap. Lever arm 3 is an elongate element having an end 3*c* pivotally connected to a second arm 4, by way of horizontal pivot pin 4*b*. Body 1 is provided with an internally projecting part 1*b*, and the end of lever arm 3 distant from end 3*c* is positioned to bear against this part 1*b* (see FIG. 2), as explained further below.

The relative positioning of the pivoting mechanism of arms 3 and 4 is configured to provide the required leverage to remove a bottle cap. Arm 4 is mounted within a vertical channel forming a part of socket 6, which terminates in a raised wall part 6*b*. Wall part 6*h* is configured to key within or against one or more straight longitudinal ribs projecting from the inner face of body 1, to prevent rotation between the socket and the body.

The lower end of arm 4 is provided with a hooking member 4*a* which projects inwardly within socket 6. Socket 6 has an internal shoulder 6*a* on the internal side opposite arm 4, shoulder 6*a* ramped upwardly and inwardly. Socket 6 includes, on or near said shoulder 6*a*, a magnetic element (not shown), to retain a bottle cap once removed, The dimensions and form of hooking member 4*a* are such that when socket 6 is placed over a crown cap on the mouth of a bottle, the member 4*a* engages with the underside of the rim of the cap, the other side of the cap engaging against internal shoulder 6*a* and, by virtue of the ramped form, the cap being urged firmly towards engagement with the hooking member 4*a*. If required, a spring or other resilient means may be provided (for example, between arm 4 and the inside of the channel of socket 6) which further urges the hooking member 4*a* inwardly to engage under the rim of the bottle cap.

As shown in the figures, a tension spring 3*b* is connected between arm 3 (attached to upwardly projecting tab 3*a*) and a slot 6*c* formed in the outer wall of the vertical channel of socket 6. Spring 3*b* has the effect of returning the mechanism to its first configuration when the push force is removed. For clarity, spring 3*b* is not shown in the cutaway views of FIGS. 2 and 5, although slot 6*c* into which the spring end engages is visible in these views.

When uncapping a bottle with a crown cap, the opener is placed on top of the bottle cap, so that the cap and the mouth of the bottle locates within receiving socket 6. The dimensions of the opener, and the inward shaping of socket 6, means that the cap bears against shaped internal shoulder 6*a*. At the same time, hooking member 4*a* at the lower end of arm 4 engages under the rim of the crown cap, so to hook the cap. On pushing down on pusher 2 by the palm of the hand body 1 moves downwardly relative to socket 6, the lower annular part 1*a* of body 1 moving downwardly towards the shoulder part of the bottle. The action of internal projecting part 1*b* of body 1 against the end of lever arm 3 results in lever arm 3 rotating in a clockwise direction and acting on arm 4 as a fulcrum, so lifting it within the vertical channel. Hooking member 4 is thus lifted, so to pry the crown cap from the bottle. The top of the bottle remains stationary within socket 6, the cap effectively pivoting about the point at which it is held by internal shoulder 6*a*, and accurate uncapping results. The bottle cap is held by the magnetic element of shoulder 6*a*.

The particular relative dimensions of the mechanism (in particular, the relative positions of horizontal pivot points 4*b* and 5) may be selected such that, when arm 4 begins to rise, arm 4 moves slightly inwardly (to the right in FIG. 3), hence assisting hooked member 4*a* to firmly engage under the bottle cap rim.

When pressure is released, the spring force of spring 3*b* automatically returns the components towards their original position (first configuration), the opener can be lifted from the bottle. As will be appreciated, the pushing force from above is applied only to the top part of the bottle and therefore during use the bottle is not tilted or tipped and the cap will not simply fly off. Uncapping can thus be effected easily with one hand. As discussed above, the cap is retained within socket 6 by the magnetic element of shoulder 6*a*, which prevents it falling out in an uncontrolled manner. A light tap of the opener on a surface will result in the cap dropping out of socket 6 to be discarded.

Figure 2:
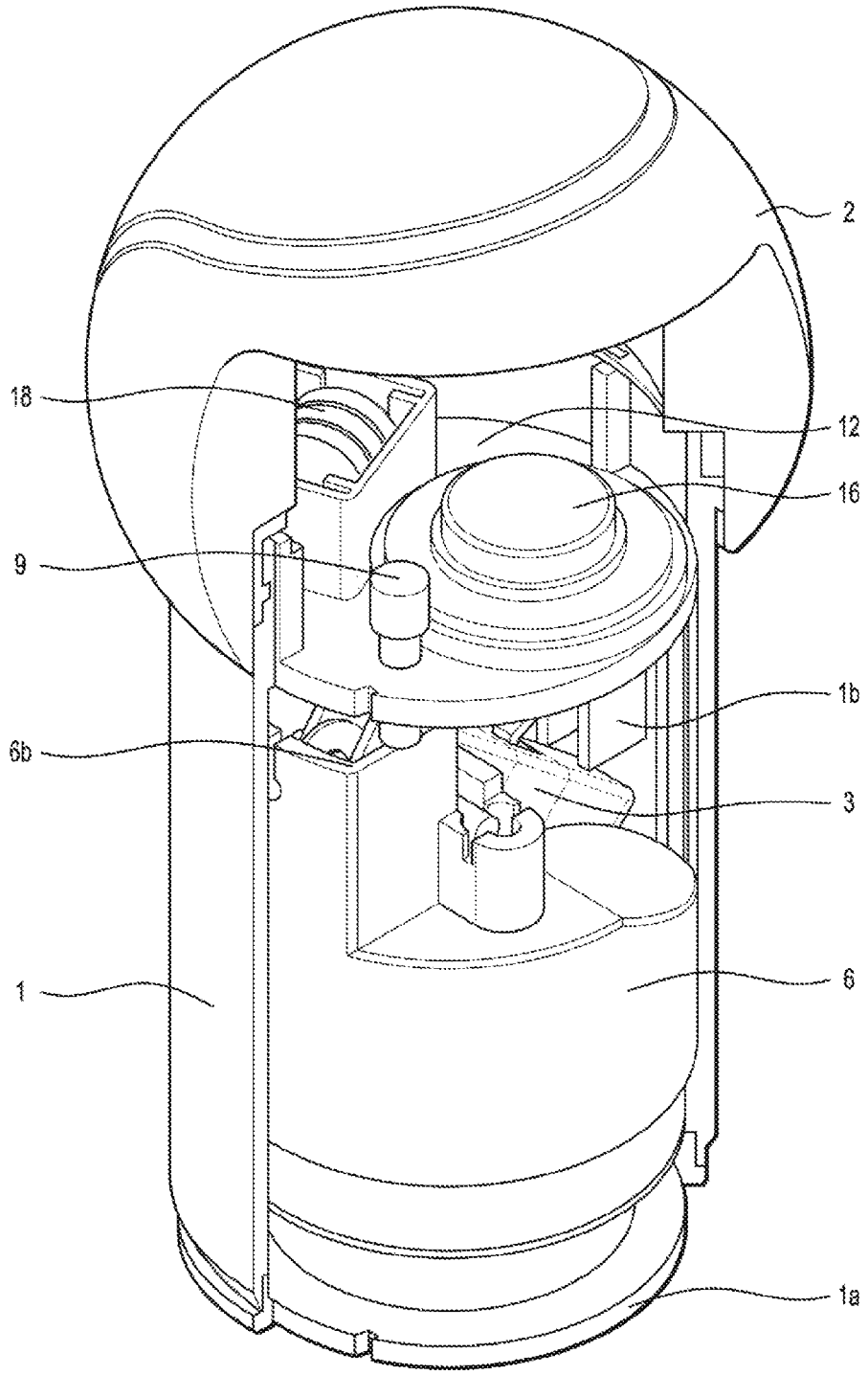
FIG. 2 provides an isometric view of a device according to the invention (a push opener with a tennis ball pusher) with a cutaway portion showing internal components.

During use, the top part of raised wall 6*h* forming the vertical channel part of socket 6 drives upward trigger pin 9, which is mounted as shown (see FIG. 2) with an elongate stem part traversing partition 12. The larger diameter upper end of trigger pin 9 ensures that it cannot fall through the aperture in partition 12 and out of upper part 10. In plan view, trigger pin 9 is coincident with activation switch 19 on PCB 14, and dimensioned such that when it is raised it presses the switch to activate the microprocessor sound unit on the PCB (powered by battery unit 18, which contains three button cells as shown in FIG. 2) to play a recorded electronic sound file via speaker 16. Once the pressure is removed the sound recording continues until playing is complete, or alternatively the device can be configured to cease playing the sound when activation switch 19 is released. A compression spring (not shown) may be provided around the stem of trigger pin 9 bearing against the tip surface of partition 12, to assist in maintaining pin 9 in a generally raised position. In this way, in its at rest position, pin 9 bears lightly against switch 19. This minimises free movement of pin 9 (and therefore rattle and wear), and ensures reliable activation of switch 19 on every use of the opener.

The selected sound file may be, for example, a tune or a song, such as an advertising jingle. The sound file is selected with regard to the shape of the pusher 2. For example, if the pusher 2 represents a football bearing the logo or name of a particular football team, the sound file to be played when the opener is used may be that team's anthem or song. If pusher 2 bears a brand name or logo of an advertiser, the sound file to be played when the opener is used may be an advertising jingle of that advertiser.

Alternatively, a sound unit may contain a plurality (eg. 10-30) different sound recordings (eg. each 2-6 seconds in duration), each related to the sport or theme represented by the shape of pusher 2, the sound unit configured such that each actuation plays a random selected one of those recordings. If pusher 2 is a 'Magic 8 Ball', the sound unit may contain a plurality of answers to questions to be asked by the user, and configured to play a random selected one of said answers on each actuation.

As described above, the sound triggering means is part of the bottle cap removing mechanism, thus providing a simple and reliable means of activating the sound file when a bottle cap is removed. Further, the construction of the device minimises risk of liquids reaching and possibly damaging the electrical and electronic components of the sound unit.

Activation of switch 19 by pin 9 may trigger an additional or alternative promotional or entertainment action, such as a light or video display.

In the embodiment described, the sports ball of the pusher part 2 is cast high density polyurethane (PU) or roto-cast polyvinyl chloride (PVC). The particular manufacturing method employed avoids part lines in the cast product.

The logos or other markings or advertising are painted, screen primed, embossed or pad printed onto the ball. Body 1 is injection moulded polycarbonate (PC). The logo or other marking or advertising on the outside of the body (eg. trophy markings) are screen printed self-adhesive vinyl decals, or may be screen printed, embossed or pad printed directly to the body.

Bottle cap receiving socket 6 is formed of a suitable plastic, but lever arms 3 and 4 and pivot pins 4*b* and 5 are preferably stainless steel. Tension spring 3*b* is corrosion-resilient steel, and the ramp part of shoulder 6*a* is also made of stainless steel.

Modifications and improvements to the invention will be readily apparent to those skilled in the art. Such modifications and improvements are intended to be within the scope of this invention.

Further, it is to be understood that, throughout, the description and claims of this specification, if and where the word 'comprise' appears (and variations of the word, such as 'comprising' and 'comprises'), this is not intended to exclude other additives, components, integers or steps.

List of parts

| Ref No | Part |
|---|---|
| 1 | Cylindrical opener body |
| 1a | Lower annular part |
| 1b | Internal projecting part |
| 2 | Top portion - eg, sports ball |
| 3 | Lever arm |
| 3a | Projecting tab |
| 3c | Lever end |
| 3b | Spring |
| 4 | Second arm |
| 4a | Hooking member |
| 4b | Pivot pin linking arms |
| 5 | Pivot for lever arm |
| 6 | Bottle cap receiving socket |
| 6a | Internal shoulder (ramped) |
| 6b | Raised wall of socket (engages pin) |
| 9 | Trigger pin |
| 10 | Upper chamber |
| 12 | Horizontal partition |

-continued

| List of parts | |
|---|---|
| Ref No | Part |
| 14 | PCB with microchip sound unit |
| 16 | Speaker |
| 18 | Battery unit |
| 19 | Activation switch |
| 20 | Body cap |

The invention claimed is:

1. A push opener for bottles having a bottle cap receiving part, including a bottle-opening mechanism by which, when the opener is placed over a bottle such that the cap on the bottle is received within the bottle cap receiving part, and a downward force is applied to the opener, a hooking member engages the rim underside of the cap and lifts it from the bottle, wherein the bottle-opening mechanism is configured to operate a sound unit within the opener to play a sound recording when the bottle opener is used, the push opener including a trigger element for triggering the sound unit to play the sound recording, the trigger element operating to trigger the sound unit by mechanical engagement when the trigger element is moved by a part of the bottle-opening mechanism.

2. The push opener of claim 1, wherein the trigger element is moved by engagement with a part of said cap receiving part.

3. The push opener of claim 1, wherein the sound unit is mounted in a part of the opener separated from said bottle-opening mechanism.

4. The push opener of claim 3, further including a partition for separating the opener into a first portion and a second portion, wherein the sound unit is mounted in the first portion and the bottle-opening mechanism is housed in the second portion.

5. The push opener of claim 3, wherein the trigger element traverses an aperture in the partition.

6. The push opener of claim 1, including a main body enclosing the cap receiving part, wherein the bottle-opening mechanism includes a lever assembly such that when a downward force is applied to the main body, the cap receiving part rises relative to the main body, resulting in the hooking member lifting the rim of the cap relative to the bottle.

7. The push opener of claim 6, wherein the bottle-opening mechanism includes a lever pivotally mounted to said cap receiving part about a first pivot axis, said lever pivotally connected to said hooking member about a second pivot axis, said first and second pivot axis being spaced apart.

8. The push opener of claim 7, wherein the movement of said main body relative to said cap receiving part causes pivoting of said lever about said first pivot axis to lift said hooking member upwardly.

9. The push opener of claim 1, further including biasing means for biasing said hooking member inwardly towards the bottle cap as the bottle-opening mechanism is operated.

10. The push opener of claim 1, wherein the sound recording is one of a plurality of sound recordings stored in the sound unit.

11. The push opener of claim 10, wherein the sound recording played is randomly or pseudo-randomly selected from the plurality of sound recordings.

12. The push opener of claim 1, further including a magnetic portion for magnetically retaining the cap after removal from the bottle.

13. The push opener of claim 1, including an upper pusher portion to which a downward force is applied in operating the opener, the upper pusher portion being shaped like a sports ball.

14. The push opener of claim 13, wherein the pusher portion is shaped like a soccer ball, rugby ball, tennis ball, basketball, golf ball, baseball, volleyball, Australian Rules football, gridiron ball or cricket ball.

15. The push opener of claim 13, wherein a theme of the sound recording matches the theme of a sport associated with the ball.

16. A push opener for bottles, including a mechanism configured to:

(a) remove a bottle cap when the opener is introduced over a bottle and pushed downwardly, the removal realised by a bottle-opening mechanism, and (b) trigger an action unit to perform a promotional or entertainment action, wherein the triggering of the action unit is realised by a trigger element within the opener as the opener is pushed downwardly;

and wherein the push opener has a body within which the top of the bottle is received, the body having a partition therein, said trigger element traversing an aperture in said partition, the partition providing effective fluid separation between said bottle-opening mechanism and said action unit.

* * * * *